US008366990B2

(12) United States Patent
Helanto et al.

(10) Patent No.: US 8,366,990 B2
(45) Date of Patent: Feb. 5, 2013

(54) REPAIRABLE SLIDE SHUTTER PLATE AND/OR BOTTOM NOZZLE BRICK AND METHODS FOR THE MANUFACTURE AND REPAIR OF A REPAIRABLE SLIDE SHUTTER PLATE AND/OR BOTTOM NOZZLE BRICK

(75) Inventors: Erkki Helanto, Kirkkonummi (FI); Mikael Silfvenius, Tammisaari (FI)

(73) Assignee: Indref Oy, Bollsta (FI)

( * ) Notice: Subject to any disclaimer, the term of this patent is extended or adjusted under 35 U.S.C. 154(b) by 263 days.

(21) Appl. No.: 12/657,294

(22) Filed: Jan. 15, 2010

(65) Prior Publication Data

US 2010/0181350 A1 Jul. 22, 2010

(30) Foreign Application Priority Data

Jan. 15, 2009 (FI) ..... 20095029

(51) Int. Cl.
*B22D 41/22* (2006.01)

(52) U.S. Cl. ..... 266/45; 222/600

(58) Field of Classification Search ..... 222/600, 222/590, 594; 266/236, 287, 45
See application file for complete search history.

(56) References Cited

U.S. PATENT DOCUMENTS

| | | | | |
|---|---|---|---|---|
| 3,970,283 | A | 7/1976 | Hind | |
| 4,017,010 | A * | 4/1977 | Meier | 222/590 |
| 4,177,943 | A | 12/1979 | Suzuki | |
| 4,555,094 | A * | 11/1985 | Evertz et al. | 266/45 |
| 4,568,007 | A | 2/1986 | Fishler | |
| 4,586,699 | A * | 5/1986 | Bachmann et al. | 266/287 |
| 4,597,514 | A | 7/1986 | Thrower | |
| 4,720,083 | A * | 1/1988 | Zverina et al. | 266/275 |
| 4,842,172 | A * | 6/1989 | Kleinevoss et al. | 222/600 |
| 4,911,338 | A | 3/1990 | Winkelmann et al. | |
| 6,263,897 | B1 | 7/2001 | Saeki et al. | |
| 2005/0067746 | A1 | 3/2005 | Ogata | |

FOREIGN PATENT DOCUMENTS

| | | |
|---|---|---|
| AU | 7633181 | 4/1983 |
| EP | 2011591 | 1/2009 |
| GB | 2307876 | 6/1997 |
| JP | 52135834 | 11/1977 |
| JP | 8057601 | 3/1996 |
| JP | 9278556 | 10/1997 |
| JP | 10338578 | 12/1998 |

* cited by examiner

*Primary Examiner* — Scott Kastler
(74) *Attorney, Agent, or Firm* — Ware, Fressola, Van Der Sluys & Adolphson LLP

(57) ABSTRACT

The invention relates to a recyclable slide shutter plate (1) and/or bottom nozzle brick (2). The invention comprises the slide shutter plate (1) and/or bottom nozzle brick (2), the outer part (6) and inner part (7) of which are connected to each other in a detachable manner. In addition, the invention comprises methods for the manufacture and repair of a repairable slide shutter plate (1) and/or bottom nozzle brick (2).

3 Claims, 1 Drawing Sheet

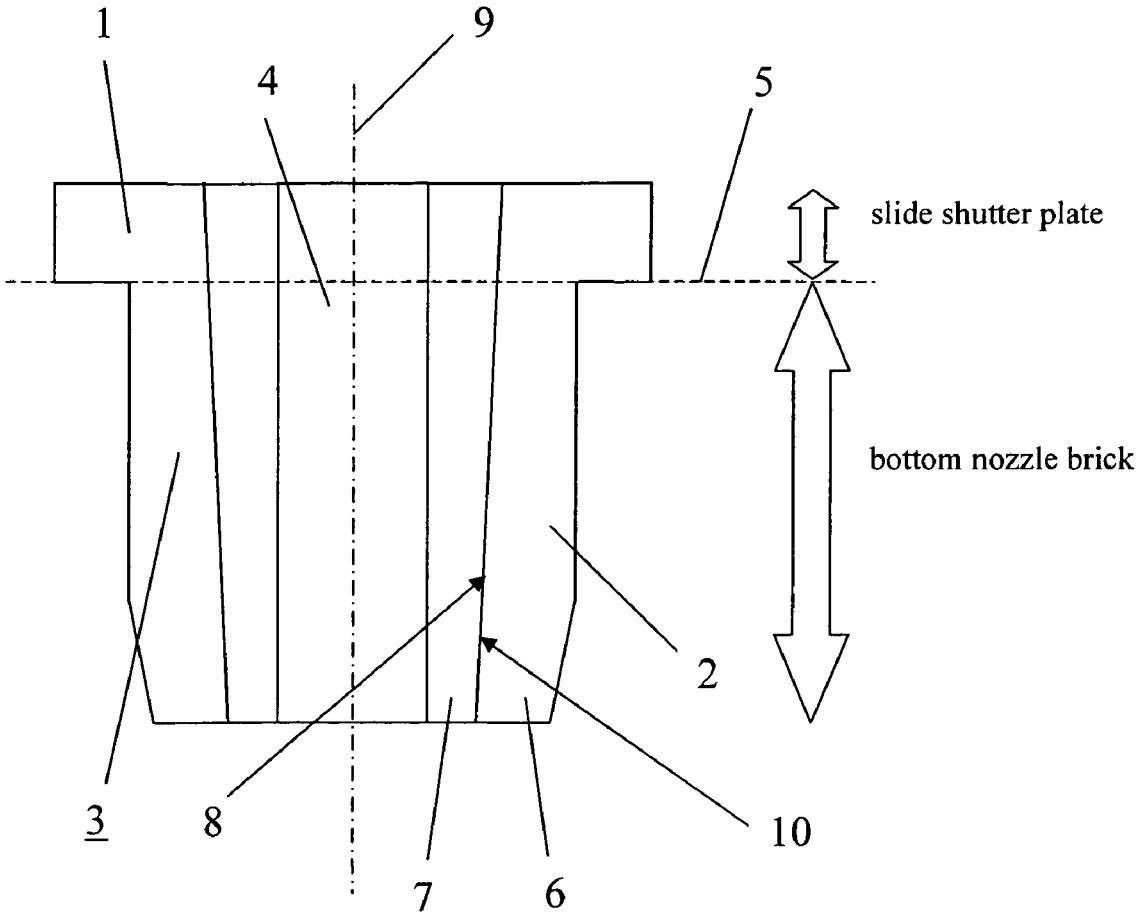
1
9
4
5
slide shutter plate
bottom nozzle brick
2
3
8
10
7
6

REPAIRABLE SLIDE SHUTTER PLATE AND/OR BOTTOM NOZZLE BRICK AND METHODS FOR THE MANUFACTURE AND REPAIR OF A REPAIRABLE SLIDE SHUTTER PLATE AND/OR BOTTOM NOZZLE BRICK

CROSS REFERENCE TO RELATED APPLICATION

This application claims priority under 35 USC §119(e) to Finnish Patent Application No. 20095029 filed on Jan. 15, 2009.

TECHNICAL FIELD

The object of the invention is a repairable slide shutter plate and/or bottom nozzle brick to be used in the casting of molten metal and methods for the manufacture and repair of a repairable slide shutter plate and/or bottom nozzle brick.

BACKGROUND OF THE INVENTION

Slide shutter plates are generally used in the casting of molten metal to dose molten metal, for example, into casting moulds. Such a slide shutter plate package may also comprise a bottom nozzle brick which is connected as one piece to the lowermost slide shutter plate and which is compressed to a shroud during casting. Traditionally, slide shutter plates and bottom nozzle bricks are made of pressed burnt brick, but also various refractory sealing compounds have been used in their manufacture.

Molten metal wears away slide shutter plates/bottom nozzle brick so that they have to be replaced or alternatively repaired at certain intervals. According to the state of the art, the repair can be made by using a diamond drill to drill the flow aperture bigger. Drilling requires very heavy tools and is financially expensive; it also takes a lot of time. For improving wear resistance, various wear-resistant coatings have also been prepared to the inner surface of the slide shutter plate/bottom nozzle brick. Coating requires special knowledge/tools and takes a lot of time and money. A slide shutter plate/bottom nozzle brick can typically be used in approximately five castings before its replacement or drilling so that this is a part that has to be replaced quite often in the casting process.

SUMMARY OF THE INVENTION

The purpose of the invention is to eliminate the drawbacks disclosed above and to achieve an economically viable solution for the repair of a slide shutter plate/bottom nozzle brick. The invention comprises both a repairable slide shutter plate/bottom nozzle brick and methods for the manufacture and repair of a slide shutter plate and/or bottom nozzle brick.

This purpose can be achieved according to the invention by manufacturing a slide shutter plate/bottom nozzle brick of two nested pieces so that the innermost of these pieces can be easily replaced by a new one after wearing. The outermost piece can be retained and used again as such, or with small repairs.

More particularly the invention is characterised in what has been disclosed in the characterising parts of the independent claims. Other advantageous embodiments have further been disclosed in the dependent claims.

BRIEF DESCRIPTION OF THE DRAWINGS

The invention will next be explained in more detail referring to the enclosed drawing, in which the FIGURE illustrates a repairable combination of a slide shutter plate/bottom nozzle brick.

DETAILED DESCRIPTION

In the FIGURE the slide shutter plate 1 and bottom nozzle brick 2 build one entity 3 with a flow aperture 4 for molten material. The bottom nozzle brick 2 and the slide shutter plate 1 can also be two different parts, both provided with a replaceable inner part 7. This entity has been built of two separate parts connected to each other. In the FIGURE this imaginary parting surface of the bottom nozzle brick 2 and slide shutter plate 1 has been marked by the dashed line 5.

The entity (combination) 3 consisting of the bottom nozzle brick 2 and slide shutter plate 1 is made of two nested parts, the outer part 6 and inner part 7. The outer part 6 can be used again only by providing it with a new inner part 7. Such an inner part 7 forms the wearing section of the two-part structure and the outer part 6 remains then completely undamaged in the casting process. When the inner part 7 has become unusable after approximately five castings, it is removed from the interior of the outer part 6 by making the outer part and the inner part to adopt opposite movement in the direction of their middle axis 8. After the used inner part 7 has been removed, the inner surface 8 of the outer part 6 is treated with a release agent, and a corresponding new inner part is cast to replace the removed old inner part so that the entity 3 is again ready for use. With such a method it is not necessary to replace the whole piece and no expensive and time consuming work methods, for example drilling, need to be used in the repair, and the product is fit for recycling. It is important to provide the outer part 6 with a release agent so that the pieces 6 and 7 can be more easily detached from each other by making them adopt divergent movement in the direction of their middle axis 9. Likewise, the outer part 6 is provided with a small relief in the exit direction of the inner part, which facilitates the detachment. If there is no relief it is probable that the piece or pieces 6 and 7 break down when detached.

If when manufacturing a new combination of a slide shutter plate/bottom nozzle brick (or when manufacturing the pieces as separate parts) the inner part 7 is manufactured first and the outer part 6 only after that, the outer surface 10 of the inner part is naturally treated with a release agent before casting the outer part.

One embodiment is to manufacture a slide shutter plate/bottom nozzle brick combination (or when manufacturing the pieces as separate parts) so that both the inner part 7 and the outer part 6 are manufactured as separate pieces, after which they are connected to form an entity. In this case it is natural that the release agent treatment can be done to either one part or both parts.

The method of the invention for the manufacture of a repairable slide shutter plate 1 and/or bottom nozzle brick 2 comprises the following steps:

- arranging the outer part 6 of the slide shutter plate 1 and/or bottom nozzle brick 2;
- treating the inner surface 8 of the outer part 6 of the slide shutter plate 1 and/or bottom nozzle brick 2 with a release agent; and
- casting a detachable inner part 7 of refractory casting mass inside the outer part 6;

or arranging the inner part 7 of the slide shutter plate 1 and/or bottom nozzle brick 2;

treating the outer surface 10 of the inner part 7 of the slide shutter plate 1 and/or bottom nozzle brick 2 with a release agent; and casting the outer part 6 of refractory casting mass onto the outer surface of the inner part 7;

or arranging the inner part 7 and the outer part 6 of the slide shutter plate 1 and/or bottom nozzle brick 2;

treating the outer surface 10 of the inner part 7 of the slide shutter plate 1 and/or bottom nozzle brick 2, the inner surface 8 of the outer part 6 or both surfaces 8 and 10 with a release agent; and joining the outer part 6 and the inner part 7 as one piece.

The method for the repair of a repairable slide shutter plate 1 and/or bottom nozzle brick 2 comprises the following steps:

detaching the used inner part 7 from the outer part 6 by making them adopt opposite movement in the direction of their middle axis 9;

treating the inner surface 8 of the outer part 6 with a release agent, and casting a new inner part 7 of a refractory casting mass for the slide shutter plate 1 and/or bottom nozzle brick 2;

or detaching the used inner part 7 from the outer part 6 by making them adopt opposite movement in the direction of their middle axis 9;

arranging the new inner part 7 of the slide shutter plate 1 and/or bottom nozzle brick 2;

treating the outer surface 10 of the inner part 7, the inner surface 8 of the outer part 6 or both surfaces 8 and 10 with a release agent; and joining the outer part 6 and inner part 7 as one piece.

After these actions, the repaired slide shutter plate/bottom nozzle brick 3 can be again inserted under the pouring ladle.

The outer part 6 and inner part 7 can be advantageously prepared by casting them of the same refractory casting mass, but the product and methods of the invention are not restricted to that the material of both parts would necessarily be identical. When needed, the outer part 6 and inner part 7 can thus be manufactured of different materials, depending on the purpose of use. For example, the outer part 6 can be made of traditional pressed burnt brick and the inner part 7 made of refractory casting mass by casting can be joined with it; the inner part can then be replaced, when needed.

Various embodiments of the invention have been illustrated above in the form of an example. By no means do they restrict the invention, and the scope of protection of the invention has been defined in accordance with the scope of protection defined by the following patent claims.

What is claimed is:

1. A combination comprising a slide shutter plate and a bottom nozzle brick, which combination is made of two nested parts, an outer part and an inner part, which parts are joined to each other in a detachable manner, where the inner part after use is to be replaced with a new inner part for repair of the combination, characterized in that:

the new inner part is of refractory casting mass cast inside the outer part and that the outer part is a refractory casting mass, the outer part has relief in the detaching direction of the inner part, and the inner surface of the outer part is provided with a release agent.

2. A method for repairing a combination comprising a slide shutter plate and a bottom nozzle brick, which combination is made of two nested parts, an outer part and an inner part, which parts are joined to each other in a detachable manner, where the inner part after use is to be replaced with a new inner part for repair of the combination, wherein the new inner part is of refractory casting mass cast inside the outer part, which method comprises the following steps:

removing the inner part after use from the interior of the outer part;

replacing a new inner part inside the outer part so that the combination is again ready for use, characterized in that the replacing step is realized by casting the new inner part of refractory casting mass inside the outer part, and in that after the step of removing the inner part after use from the interior of the outer part follows a step of treating an inner surface of the outer part with a release agent.

3. A combination comprising a slide shutter plate and a bottom nozzle brick, which combination is made of two nested parts, an outer part and an inner part, which parts are joined to each other in a detachable manner, where the inner part after use is to be replaced with a new inner part for repair of the combination, characterized in that:

the new inner part is of refractory casting mass cast inside the outer part and that the outer part is a refractory casting mass, and the inner surface of the outer part is provided with a release agent.

* * * * *